United States Patent [19]

Chang

[11] Patent Number: 4,911,884

[45] Date of Patent: Mar. 27, 1990

[54] HIGH STRENGTH NON-MAGNETIC ALLOY

[75] Inventor: Keh-Minn Chang, Schenectady, N.Y.

[73] Assignee: General Electric Company, Schenectady, N.Y.

[21] Appl. No.: 303,343

[22] Filed: Jan. 30, 1989

[51] Int. Cl.[4] ..... C22C 38/50

[52] U.S. Cl. ..... 420/96; 420/97; 148/335; 148/328; 148/330

[58] Field of Search ..... 48/335, 328, 330; 420/96, 97, 57, 586.1

[56] References Cited

U.S. PATENT DOCUMENTS

| | | | |
|---|---|---|---|
| 2,561,945 | 7/1951 | Payson | 420/36 |
| 2,865,740 | 12/1963 | Heger et al. | 420/73 |
| 3,062,692 | 11/1969 | Manganello et al. | 148/38 |
| 3,081,164 | 3/1963 | Schramm | 420/75 |
| 3,123,469 | 3/1964 | Tanezyn | 420/52 |
| 3,383,203 | 5/1968 | Baggstrom | 420/73 |
| 3,420,660 | 1/1969 | Kawahata et al. | 75/122 |
| 3,464,815 | 2/1969 | Wache | 75/124 |
| 3,663,213 | 5/1972 | Eiselstein | 75/124 |
| 4,006,012 | 2/1977 | Kindlimann | 75/122 |
| 4,086,085 | 4/1978 | McGurty | 75/124 |
| 4,165,997 | 8/1979 | Smith et al. | 148/38 |
| 4,190,437 | 2/1980 | Boesch et al. | 75/122 |
| 4,285,725 | 8/1981 | Gysel et al. | 420/44 |
| 4,484,958 | 11/1984 | Shintani et al. | 420/44 |

OTHER PUBLICATIONS

Ganesch et al., "A New High Strength Material for Turbine Generator Applications", Joint A.S.M., E.P.-R.I. International Conferences Advances in Material Technology for Fossil Sciences, Chicago, Sep. 1987.

Viswanathan, "Materials for Generator Retaining Rings", Journal of Engineering Materials and Technology, vol. 103, pp. 267–275, Oct. 1981.

Morris, J. W., and Chang, K. M., "Research Toward New Alloys for Generator Retaining Rings", Special Technical Publication 792, American Society for Testing and Materials, 1982, pp. 79–103.

*Primary Examiner*—Deborah Yee

*Attorney, Agent, or Firm*—James E. McGinness; James C. Davis, Jr.; James Magee, Jr.

[57] ABSTRACT

This invention relates to corrosion resistant, austenitic, non-magnetic alloys. The alloys contain about 32 to 38% nickel, about 3 to 7% chromium, about 3 to 5% titanium, about 0.3 to 1.5% aluminum, about 0.5 to 1.5% molybdenum, an effective amount of vanadium, about 0.005 to 0.02% boron, up to about 0.02% carbon, and the balance substantially iron. The alloys are controlled temperature hot rolled and age annealed to provide strain hardening and precipitation strengthening to achieve yield strength objectives established for retaining rings in new high capacity generators. Yield strengths of at least about 200 ksi can be produced by the alloys of this invention making them suitable for use in new high capacity generators.

26 Claims, 2 Drawing Sheets

HIGH STRENGTH NON-MAGNETIC ALLOY

The present invention relates generally to a high strength, corrosion resistant, non-magnetic, austenitic alloy, and more specifically, it relates to such an alloy and the thermomechanical processing necessary to produce the high yield strength necessary for application of the alloy in generator retaining rings.

BACKGROUND OF THE INVENTION

The end turns of the rotor winding in an electrical generator are restrained against centrifugal force by onepiece retaining rings located at either end of the rotor. Retaining rings are the most highly stressed component in a generator, and are of particular structural concern. The design criteria requires a high strength, high toughness material with a good resistance to stress corrosion cracking and hydrogen embrittlement. In addition, the retaining rings should be non-magnetic for optimum electromagnetic performance of the generator. A non-magnetic alloy is an alloy that does not attract magnetic substances. Retaining rings made of magnetic material have eddy currents induced in them because they are in close contact with the magnetic flux generated by conductors carrying large currents. Since magnetic materials have a higher permeability to the magnetic flux the induced eddy currents have a higher voltage than would be experienced in a non-magnetic material. These eddy currents not only represent wasted energy in the system, but their high voltage also generates heat in the rings causing undesirable operating conditions. If the rings are nonmagnetic, the energy loss is negligible and the rings remain cool.

The two alloys currently used in retaining rings for large generators are iron based austenitic alloys containing manganese and chromium. One alloy contains 18% manganese and 5% chromium while the other more recently developed alloy is more corrosion resistant and contains 18% manganese and 18% chromium. All compositions shown herein are in weight percent. Progressively higher yield strengths up to 175 ksi have been achieved in retaining rings made from both of these alloys through extensive cold expansion and nitrogen addition. As used herein yield strength is the 0.2% yield strength. The 0.2% yield strength is the stress required to produce a plastic strain of 0.2% in a tensile specimen that is tested according to a method equivalent with ASTM specification E8 ("Standard Methods of Tension Testing of Metallic Materials", Annual Book of ASTM Standards, Vol. 03.01, pp. 130–150, 1984.) The term ksi stands for kips per square inch or the unit of stress representing 1,000 pounds per square inch. Cold expansion of forged rings is a demanding manufacturing process that significantly adds to the difficulty of producing retaining rings. Fracture toughness, a measure of resistance to extension of a crack is detrimentally affected by cold expansion. Fracture toughness is measured in units of ksi times square root inch and is determined by testing in accordance with ASTM test specification E399, "Standard Test Method for Plane-Strain Fracture Toughness of Metallic Materials", Annual Book of ASTM Standards, Vol. 03.01, pp. 519–554, 1984.

It is believed 175 ksi is the upper limit of attainable yield strength in the manganese-chrome alloys referred to above. However, at the 175 ksi yield strength level the 18% manganese - 5% chromium alloy has shown a strong susceptibility to aqueous stress corrosion cracking in laboratory tests (Speidel, M.O. "Stress Corrosion Cracking in Fe-Mn-Cr Alloys", Corrosion, Vol. 32, No.5, May 1976, pp. 187–199) Several corrosion related service failures of retaining rings have also been reported by Viswanathan, R., "Materials for Generator Retaining Rings" Journal of Engineering Materials and Technology, vol. 103, pp. 267–275, Oct. 1981. The 18% manganese - 18% chromium alloy has shown a tendency towards a significant drop in yield strength with a modest increase in temperature of about 100° C. A significant drop in yield strength could cause distortion or failure of the ring during operation where such modest increases in temperature can be expected. Because the 175 ksi yield strength level is utilized in current generator designs, further increases in generator size or winding density will require development of modified or new higher strength alloys.

A recently developed experimental non-magnetic alloy without manganese additions but containing 3% tantalum, designated alloy T, has the nominal composition by weight percent: 34.5% nickel, 5% chromium, 3% titanium, 3% tantalum, 1% molybdenum, 0.5 aluminum, 0.3% vanadium, 0.01% boron, and balance iron. In "Research Toward New Alloys for Generator Retaining Rings", Special Technical Publication 7922, American Society for Testing and Materials, 1982, pp. 79–103, Morris, J., and Chang, K.M., indicated that this alloy has the potential to reach properties unattainable with the manganese-chromium alloys currently used. Attainable property objectives were identified as a 200 ksi minimum yield strength and a 100 ksi times square root inch fracture toughness. Furthermore, these property objectives were obtained by processing alloy T without the demanding cold expansion processing. Hot working followed by age annealing was the only processing required.

In another recently developed alloy similar to alloy T niobium was substituted for part of the tantalum. This was done in alloy TTL described in, Ganesh, S., Viswanathan, R., "A New High Strength Material for Turbine Generator Applications", Joint A.S.M., E.P.-R.I. International Conference, Advances in Material Technology for Fossil Sciences, Chicago, Sept. 1987. In alloy TTL the tantalum was reduced to 1% and 1% niobium was added. However, with this change in composition the processing step of cold expansion, sometimes hereafter referred to as cold working, had to be added to meet the 200 ksi yield strength objective. Alloy TTL could not be sufficiently strengthened by hot working and age annealing alone. Therefore additional strengthening was induced through strain hardening. Strain hardening occurs when a workpiece is permanently deformed at temperatures that are low enough to allow the strain caused by deformation to be retained in the workpiece. It is preferable to induce strain during hot working since it is much more difficult to induce strain when the workpiece is at lower temperatures and the yield strength is higher.

However, alloy TTL is restricted in the temperatures it can be hot worked. Between about 750° to 850° C. alloy TTL experiences a reduction in ductility that causes cracking and tearing of the workpiece during hot working. Such ductility dips are expected in niobium or titanium strengthened alloys. As a result alloy TTL must be hot worked above 850° C. When hot worked above 850° C. insufficient hot working strains are retained in the workpiece to meet the 200 ksi yield strength objective. Additional strain hardening had to b induced with a 25% cold working strain to meet the yield strength objective. Although the mechanical property goals were met this alloy still contains tantalum, and requires a significant amount of cold working to achieve the yield strength objective of 200 ksi. Whereas it is a primary object of this invention to provide a new nonmagnetic alloy capable of meeting or exceeding the 200 ksi yield strength objective without adding tantalum to the alloy and without inducing cold working strains in a workpiece made from the alloy.

A further object is to provide a new non-magnetic alloy having a fracture toughness of about 100 ksi times square root inch when the alloy is processed to produce a 200 ksi yield strength.

SUMMARY OF THE INVENTION

These and other objects are achieved by hot working and age annealing an iron based alloy that does not contain a tantalum addition or require cold working to achieve a 200 ksi yield strength.

Alloys of this invention have a composition in weight percent of about 32 to 38% nickel, about 3 to 7% chromium, about 3 to 5% titanium, about 0.3 to 1.5% aluminum, about 0.5 to 1.5% molybdenum, an effective amount of vanadium, about 0.005 to 0.02% boron, up to about 0.02% carbon, and the balance substantially iron. As used herein the phrase "balance substantially iron" means that the iron is the predominant element being greater in content than any other element present in the alloy. However, other elements which do not interfere with achievement of the yield strength and fracture toughness objectives of the alloy may be present either as impurities or up to a non-interfering level. Some of the elements which do not interfere with such desirable properties, are discussed below, and the presence of these elements must be minimized.

Molybdenum, vanadium, and boron are added to serve as scavengering elements. Scavengering elements improve alloy ductility and toughness by preventing intergranular brittleness and impeding intergranular precipitation. Therefore, the term "effective amount of vanadium" means an amount of vanadium in combination with the molybdenum and boron present in alloys of this invention that will produce a scavengering effect sufficient to provide ductility of at least about 12% tensile elongation and fracture toughness consistent with the yield strength to fracture toughness relationship shown by the dashed line in FIG. 2.

Pursuant to one method of the present invention an ingot from which a billet, slab, or any other primary workpiece is derived, is cast from a melt having the composition as described above. The ingot is heated at approximately 1200° C. for about 24 hours. Ingot heating is followed by primary and secondary forging of the workpiece at approximately 1100° C. The workpiece is then controlled temperature hot rolled where a reduction in cross-sectional area of at least about 25% in the temperature range of about 650° to 850° C. is made. An aging anneal treatment is preferably performed directly after the controlled temperature hot rolling to maximize precipitation strengthening. One aging anneal treatment is an isothermal aging anneal between about 600° and 800° C. for approximately 8 to 24 hours.

The resulting alloy is stable in the austenite phase making it non-magnetic. It is also corrosion resistant, and capable of 0.2% yield strength of at least about 200 ksi and a fracture toughness of at least about 70 ksi times square root inch.

DETAILED DESCRIPTION OF THE INVENTION

Figure 1:
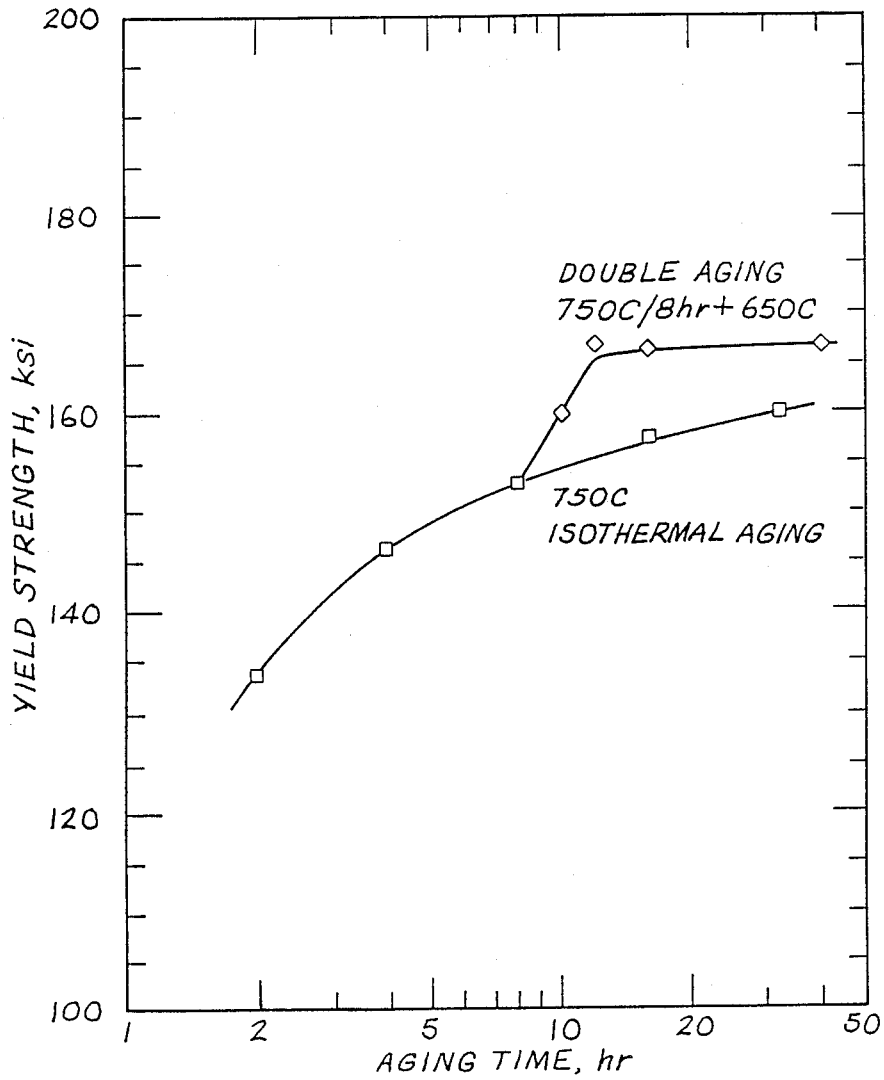
FIG. 1 is a graph of the yield strengths achieved when alloys of this invention are given an isothermal aging anneal or a double-aging anneal directly after hot forging as performed in Example I.

The alloy of the present invention achieves higher yield strengths over alloys presently used in generator retaining rings while maintaining adequate fracture toughness. It achieves the mechanical property objectives established for new higher capacity generators with a simplified thermomechanical processing that does not include cold working. In addition the alloy composition does not include tantalum to achieve the property objectives.

Alloys of this invention have a composition of: about 32 to 38% nickel, about 3 to77% chromium, about 3 to 5% titanium, about 0.5 to 1.5% molybdenum, about 0.3to 1.5% aluminum, about 0.005 to 0.02% boron, an effective amount of vanadium, up to about 0.02% carbon and the balance substantially iron. Carbon should be kept as low as is possible using commercial melting practices preferably not exceeding 0.02% by weight. Impurities such as nitrogen, oxygen, phosphorous, sulfur, and the like that are acquired in processing, adversely affect the attainable mechanical properties and should be kept as low as possible.

A preferred composition within the scope of the invention is: about 35% nickel, about 5% chromium, about 3.5% titanium, about 1.0% molybdenum, about 0.9% aluminum, about 0.1% boron, about 0.3% vanadium, about 0.01% carbon, and the balance substantially iron.

Standard vacuum induction melting or vacuum arc remelting used in the production of commercial superalloys is recommended for melting the alloy and producing an ingot. An ingot with a uniform structure and minimal inclusions or segregation of any elements is preferred to attain the desired mechanical property objectives of a 200 ksi yield strength and 100 ksi times square root inch fracture toughness.

The initial hot working of the ingot to form a slab, billet, or other primary workpiece is standard primary forging which starts at 1100° to 1200° C. Enough reduction is made to homogenize the structure and refine the grain size uniformly. The workpiece is reheated as needed to maintain the temperature between 950°-1000° C. during secondary forging.

In accordance with the present invention, a strain hardening step in the process follows the forging of the workpiece. The strain hardening step is a controlled temperature hot rolling. Controlled temperature hot rolling is carried out between about 650° and 850° C. where at least about 25%, preferably about a 30% or higher, reduction in cross-sectional area is made.

The hot rolling reduction creates strains in the crystalline matrix of the alloy. These strains are pinned because precipitates form in this temperature range at the very time that the alloy is undergoing the hot rolling reduction. This is known as strain hardening, and the ability to induce this amount of strain hardening during hot rolling is unexpected among alloys with niobium or titanium additions. The strain adds the increment of strengthening needed to achieve the 200 ksi minimum yield strength goal by increasing the yield strength approximately 60 ksi.

What is unexpected about the alloys of this invention is that hot rolling in this temperature range to induce strain hardening is only possible because alloys of this invention do not experience a high temperature ductility dip. Essentially all other titanium or niobium strengthened alloys, such as the alloy TTL discussed earlier, suffer from a ductility dip in the temperature range of 600° to 800° C. Such other alloys accordingly cannot benefit from the strain hardening brought about by the precipitate formation as the strains are induced by the hot rolling. As a result strengthening from complex cold reduction processing will not be required as it is for alloy TTL and current manganese-chrome retaining rings.

As previouusly explained such cold straining also detrimentally affects stress corrosion resistance. Since alloys of this invention will not require cold straining susceptibility to stress corrosion cracking should improve Thus, in accordance with this invention compositions having the critical combination of about 32 to 38% nickel, about 3 to 7% chromium, about 3 to 5% molybdenum, an effective amount of vanadium, about 0.005 to 0.02% boron, up to about 0.02% carbon, and the balance substantially iron, that are subject to a controlled temperature hot rolling in the range of 650° to 850° C. do not have the high temperature ductility dip of the prior art compositions.

Figure 2:
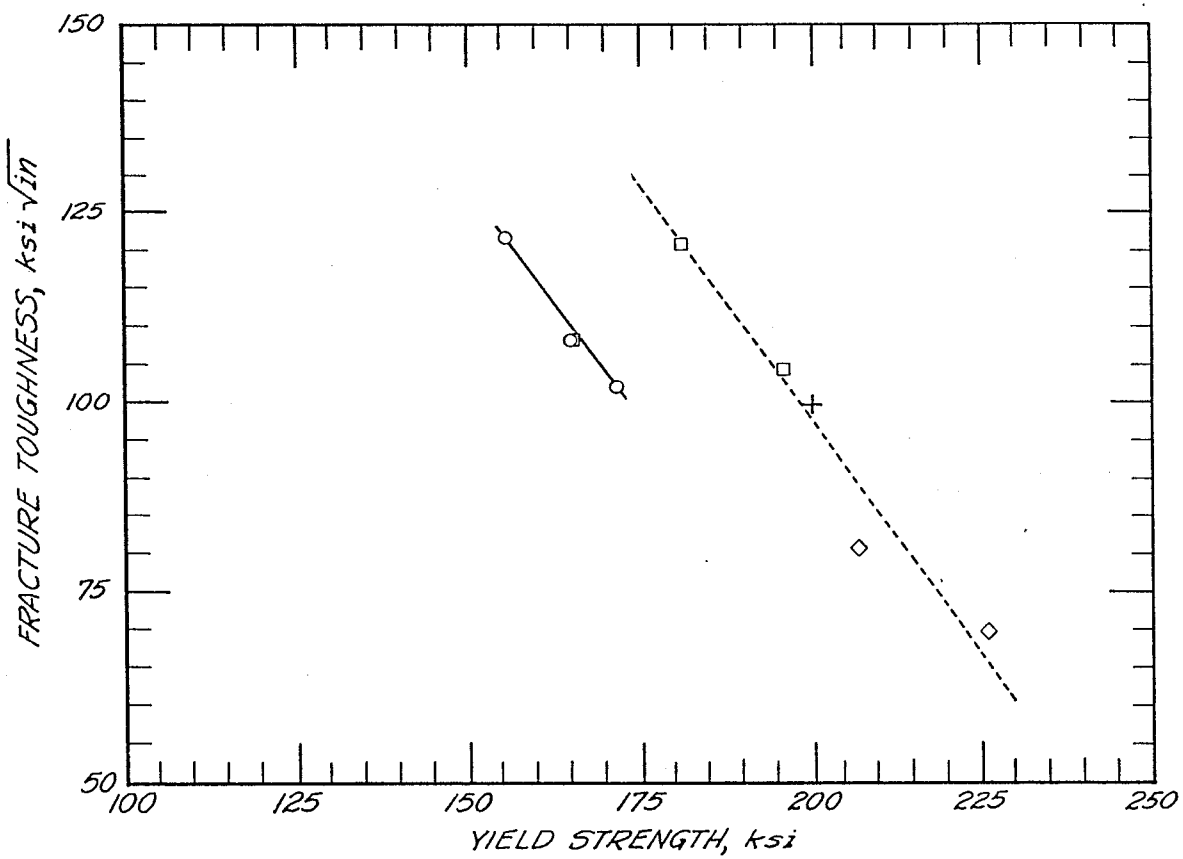
FIG. 2 is a graph of the fracture toughness and yield strengths achieved after controlled temperature hot rolling and age annealing the alloys of this invention as compared to prior art tantalum-containing alloys.

Although it is not meant to be a limitation, in most embodiments of the present invention the effective amount of vanadium may be up to about 0.5% in alloys of this invention. The minimum amount of vanadium that can be used in the alloys of this invention is an amount that in combination with the molybdenum and boron present will produce a scavengering effect sufficient to provide ductility of at least about 12% tensile elongation and fracture toughness consistent with the yield strength to fracture toughness relationship shown by the dashed line in FIG. 2. The dashed line in FIG. 2 is the yield strength to fracture toughness relationship for prior art 3% tantalum bearing alloys. Prior art 3% tantalum bearing alloys meet or exceed the 100 ksi times square root inch fracture toughness objective established for new high capacity generators. Therefore, alloys that are consistent with the yield strength to fracture toughness relationship of the prior art 3% niobium alloys can be expected to meet this same fracture toughness objective. Amounts as low as about 0.3% vanadium or lower may be used in the alloys of this invention to achieve the desired scavengering effect.

Successful hot rolling of a precipitation strengthened alloy like the alloys of this invention or the tantalum or niobium bearing alloys discussed previously in the temperature range of 650° to 850° C. also depends on the ease with which the alloy can be strained. Rapid formation of precipitates in this temperature range would cause rapid hardening of the alloy making it very difficult to strain during rolling. Between 650° to 850° C. the precipitation reaction in the alloys of this invention proceeds slowly. This benefits the hot rollability of the alloys of this invention by making it easier to induce a uniform strain in the workpiece.

After hot rolling, the alloy may be rapidly quenched and solution annealed followed by aging anneal treatments. Preferably, the alloy receives the aging anneal directly after hot rolling without traditional solution anneals since this has been found to produce a higher yield strength for the same fracture toughness.

Two types of aging anneals can be performed. One is an isothermal aging anneal between about 600° and 800° C. for approximately 8 to 24 hours. This will provide sufficient precipitation strengthening to achieve a yield strength of at least about 200 ksi. A preferred alternative aging anneal is a double-aging anneal that can achieve a higher strengthening effect within a shorter processing time. The double-aging anneal is about a 720° to 780° C. anneal for approximately 2 to 8 hours and a secondary treatment at about 600° to 700° C. for approximately 4 to 16 hours.

The combination of the specified chemistry and thermomechanical processing produces an alloy with a yield strength of at least about 200 ksi and a fracture toughness of at least about 70 ksi times square root inch.

The following examples are provided to illustrate the practice of this invention.

Example I

A heat of the following composition was melted and cast as an ingot:

| Element | Weight Percent |
|---|---|
| Fe | Balance |
| Ni | 35.15 |
| Cr | 5.47 |
| Ti | 3.91 |
| Al | 0.73 |
| Mo | 1.07 |
| V | 0.38 |
| C | 0.0019 |
| B | Not Available |

The ingot was heat treated in a vacuum at 1200° C. for 24 hours. The ingot was then repeatedly forged at 1100° C. to produce a slab that was cut into two. Small sample portions were removed from the slab and were subjected to age annealing treatments.

Example II

One of the slabs produced in Example I was then hot rolled at about 650° C. and the other slab was hot rolled at about 850° C. A reduction in cross-sectional area between about 35 to 40% was taken in each slab during the hot rolling. No cracking or tearing was experienced in either slab confirming the absence of the ductility dip behavior in this temperature range. This is unexpected for the alloys of this invention as all related prior art niobium or titanium strengthened alloys exhibit such a ductility dip. Sample portions taken from the hot rolled slabs were then subjected to different aging anneal treatments within the time and temperature parameters shown in Table I below. The aging anneal treatments in Table I with the exception of tests 1 and 5 are within the scope of the age anneal treatments of this invention.

Test results from the sample portions in Example I are plotted in FIG. 1. They show that the desired strengthening needed o achieve the 200 ksi yield strength objective was not achieved by simply hot forging and age annealing. In other words, without the controlled temperature hot rolling yield strengths only ranging from 139 to 168 ksi were realized FIG. 1 also demonstrates the improved precipitation strengthening from the double-aging anneal (designated by diamond data points) as compared to the isothermal aging anneal (designated by square data points).

Test results from the sample portions in Example II are shown in Table I below and plotted in FIG. 2.

TABLE I

Tensile Properties of Alloy RRA-1 Subjected to Controlled Temperature Rolling

| Test Number | | *Y.S. ksi | *T.S. ksi | *El % | Reduction in Area % | Fracture Toughness ksi · $\sqrt{in}$ |
|---|---|---|---|---|---|---|
| | Controlled Temperature Hot Rolled at 850° C.: | | | | | |
| | Isothermal Aging Anneal | | | | | |
| 1 | 750° C./4 hr. | 194 | 218 | 13 | 42 | |
| 2 | 720° C./8 hr. | 200 | 223 | 13 | 45 | |
| | Double-Aging Anneal | | | | | |
| 3 | 750° C./4 hr. + 650° C./6 hr. | 201 | 228 | 12 | 33 | |
| 4 | 720° C./8 hr. + 620° C./8 hr. | 207 | 228 | 12 | 45 | 81 |
| | Controlled Temperature Hot Rolled at 650° C.: | | | | | |
| | Isothermal Aging Anneal | | | | | |
| 5 | 750° C./4 hr. | 215 | 231 | 13 | 44 | |
| 6 | 720° C./8 hr. | 210 | 229 | 13 | 47 | |
| | Double-Aging Anneal | | | | | |
| 7 | 750° C./4 hr. + 650° C./6 hr. | 224 | 235 | 12 | 43 | |
| 8 | 720° C./8 hr. + 650° C./8 hr. | 226 | 239 | 12 | 44 | 70 |

*Y.S. = Yield Strength, T.S. = Tensile Strength, El — Elongation

The data in Table I shows that when the controlled temperature hot rolling of this invention is performed as in Example II the yield strength and fracture toughness objectives can be achieved. The data in Table I also shows that yield strength increases with a decreasing hot rolling temperature. Yield strength also increases when the preferred double-aging anneal is used. Only test number one is slightly below the 200 ksi yield strength objective. However, test number one was age annealed for 4 hours while the specified time for the isothermal aging anneal is about 8 to 24 hours. Test number two received an 8 hour isothermal aging anneal at a temperature lower than test one. Despite the lower aging temperature the increased aging time provided additional precipitation strengthening, and test two achieved a 200 ksi yield strength.

The data obtained from the samples in Example II are plotted in FIG. 2 to compare the fracture toughness of the alloys of this invention when processed according to the method of this invention (diamond data points), to alloys of this invention when processed to receive a solution anneal before age annealing (round data points), and to the prior art 3% tantalum bearing alloys (square data points). When alloys of this invention receive the extra solution annealing treatment fracture toughness improves but yield strength is greatly reduced below the 200 ksi objective.

The dashed line in FIG. 2 connects the square data points of the prior art 3% tantalum alloy to the diamond data points of the alloys of this invention This is significant because it is expected that as yield strength increases fracture toughness will decrease. The dashed line in FIG. 2 shows how the fracture toughness can be expected t decrease as the yield strength of the prior art 3% tantalum alloy increased. The fracture toughness of the alloys of this invention measured in tests 4 and 8 are consistent with the extrapolated values represented by the dashed line. The property objectives for new high capacity generators represented by the + on FIG. 2 also fall along this line. Therefore, the alloys of this invention should achieve the fracture toughness objective of 100 ksi times square root inch when processed to achieve the yield strength objective of 200 ksi.

Magnetic permeability tests performed on all samples after the final aging anneal treatment confirmed the alloys of this invention are substantially non-magnetic.

The alloys of this invention may achieve a yield strength of at least about 200 ksi and are non-magnetic, austenitic alloys with adequate fracture toughness and corrosion resistance to satisfy demands for new higher capacity generators where retaining rings of greater strength are required. In addition, this is accomplished with greatly simplified processing over that used on current manganese-chromium alloy rings. The manganese-chromium alloy rings require extensive cold working to achieve the 175 ksi yield strength required in present retaining rings. Elimination of cold working requirements substantially simplifies the production of retaining rings made from the alloys of this invention. Stress corrosion resistance should also improve since cold straining is known to detrimentally affect it. Also yield strength and fracture toughness objectives beyond the limits of manganese-chromium alloys currently used to produce retaining rings were achieved without making tantalum additions to the alloys of this invention.

While not a complete list examples of articles that may be produced from the alloys of this invention and thereby benefit from its improved properties and simplified processing are retaining rings and wedges used in turbogenerators, and non-magnetic sighting tubes.

From the preceding description of the present invention in conjunction with the preferred embodiments thereof, it should be apparent to those skilled in the metallurgical art that modifications and variations may be resorted to without departing from the spirit and scope of the invention which is limited only by the appended claims.

What is claimed is:

1. A non-magnetic, corrosion resistant, austenitic alloy consisting of by weight percent:

about 32 to 38% nickel, about 3 to 7% chromium, about 3 to 5% titanium, about 0.3 to 1.5% aluminum, about 0.5 to 1.5% molybdenum, an effective amount of vanadium for inhibiting intergranular precipitation, about 0.005 to 0.02% boron, up to about 0.02% carbon, and the balance substantially iron;

said alloy being capable of achieving a 0.2% yield strength of at least about 200 ksi with at least about a 70 ksi times square root inch fracture toughness, said alloy further being capable of being hot rolled at a controlled temperature between about 650° C. to 850° C. into a workpiece and reducing the cross-section of the workpiece up to at least 40 percent during the hot rolling without cracking the workpiece.

2. An alloy consisting of about 35% nickel, about 5% chromium, about 3.5% titanium, about 0.9% aluminum, about 1% molybdenum, about 0.3% vanadium, about 0.01% boron, about 0.01% carbon, and the balance substantially iron.

3. The alloy as defined in claim 1 wherein the weight percent of vanadium is about 0.3% to 0.5%.

4. A product of the alloy according to claim 1 which has been strain hardened by controlled temperature hot rolling, and which has been precipitation hardened.

5. An article that is formed from a non-magnetic, corrosion resistant alloy, comprising:

said article being formed from a slab with a composition consisting of by weight percent;

about 32 to 38% nickel, about 3 to 7% chromium, about 3 to 5% titanium, about 0.3 to 1.5% aluminum, about 0.5 to 1.5% molybdenum, an effective amount of vanadium for inhibiting intergranular precipitation, about 0.005 to 0.02% boron, up to about 0.02% carbon, and the balance substantially iron; and said slab having been formed with a controlled temperature hot rolling between about 650° C. to 850° C. to reduce the cross-sectional area thereof at least about 25% to give the article its final dimension and age annealing the dimensioned article between about 600° C. to 800° C. for about 8 to 24 hours.

6. The article of claim 5 wherein the alloy of said slab consists of by weight percent:

about 35% nickel, about 5% chromium, about 3.5% titanium, about 0.9% aluminum, about 1% molybdenum, about 0.3% vanadium, about 0.01% boron, about 0.01% carbon, and the balance substantially iron.

7. The article of claim 5 wherein the vanadium content of the alloy of the slab is about 0.3% to 0.5% by weight.

8. The article of claim 5 wherein the article has been age annealed with a double-aging treatment comprising a first anneal at about 720° C. to 780° C. for about 2 to 8 hours, followed by a second anneal at about 600° C. to 700° C. for about 4 to 16 hours.

9. The article of claim 5 wherein the slab is a billet.

10. The article of claim 8 wherein the slab is a billet.

11. A structural member, said member having been formed of a non-magnetic, corrosion resistant, austenitic alloy consisting of, by weight percent:

about 32 to 38% nickel, about 3 to 7% chromium, about 3 to 5% titanium, about 0.3 to 1.5% aluminum, about 0.5 to 1.5% molybdenum, an effective amount of vanadium for inhibiting intergranular precipitation, about 0.005 to 0.02% boron, up to about 0.02% carbon, with the balance substantially iron; and said article being capable of achieving a 0.2% yield strength of at least about 200 ksi with a fracture toughness of at least about 70 ksi times square root inch.

12. The member of claim 11 wherein the alloy composition by weight percent is:

about 35% nickel, about 5% chromium, about 3.5% titanium, about 0.9% aluminum, about 1% molybdenum, about 0.3% vanadium, about 0.01% boron, about 0.01% carbon, and the balance substantially iron.

13. The member of claim 11 wherein the vanadium content is about 0.3 to 0.5% by weight.

14. A member according to claim 11 which has been strain hardened by controlled temperature hot rolling, and then precipitation hardened.

15. The member of claim 11 wherein the member is a generator retaining ring.

16. The member of claim 14 wherein the member is a generator retaining ring.

17. A process for achieving a 0.2% yield strength of at least about 200 ksi and a fracture toughness of at least about 70 ksi times square root inch in an austenitic, corrosion resistant, non-magnetic alloy, said process comprising:

providing a slab of said alloy consisting of by weight percent about 32 to 38% nickel, about 3 to 7% chromium, about 3 to 5% titanium, about 0.3 to 1.5% aluminum, about 0.5 to 1.5% molybdenum, an effective amount of vanadium for inhibiting intergranular precipitation, about 0.005 to 0.02% boron, up to about 0.02% carbon, and the balance substantially iron;

hot rolling the slab at a controlled temperature between about 650° C. to 850° C. to reduce the cross-sectional area of the slab at least about 25%; and age annealing the hot rolled slab between about 600° C. to 800° C. for about 8 to 24 hours.

18. The process of claim 17 wherein said alloy of the slab consists of by weight percent; about 35% nickel, about 5% chromium, about 3.5% titanium, about 0.9% aluminum, about 1% molybdenum, about 0.3% vanadium, about 0.01% boron, about 0.01% carbon, and the balance substantially iron.

19. The process of claim 17 wherein the vanadium content of the slab is about 0.3 to 0.5% by weight.

20. The process of claim 17 wherein the controlled temperature hot rolling reduction in cross sectional area is about 30% to 40%.

21. The process of claim 17 wherein the age anneal is a double-aging treatment comprising a first anneal at about 720° C. to 780° C. for about 2 to 8 hours, followed by a second anneal between about 600° C. to 700° C. for about 4 to 16 hours.

22. A process for achieving a 0.2% yield strength of at least about 200 ksi and a fracture toughness of at least about 70 ksi times square root inch in an austenitic, corrosion resistant, non-magnetic generator retaining ring, said process comprising:

providing a billet of an alloy consisting of by weight percent about 32 to 38% nickel, about 3 to 7% chromium, about 3 to 5% titanium, about 0.3 to 1.5% aluminum, about 0.5 to 1.5% molybdenum, an effective amount of vanadium for inhibiting intergranular precipitation, about 0.005 to 0.02% boron, up to about 0.02% carbon, and the balance substantially iron;

forming said billet into at least one generator retaining ring said forming including at least a controlled temperature hot rolling of said billet between about 650° C. to 850° C. to reduce the cross section of said billet at least about 25%; and age annealing said generator retaining ring between about 600° C. to 800° C. for about 8 to 24 hours.

23. The process of claim 22 wherein the alloy of said billet consists of by weight percent; about 35% nickel, about 5% chromium, about 3.5% titanium, about 0.9% aluminum, about 1% molybdenum, about 0.3% vanadium, about 0.01% boron, about 0.01% carbon, and the balance substantially iron.

24. The process of claim 22 wherein the vanadium content of the alloy of said billet is about 0.3 to 0.5% by weight.

25. The process of claim 22 wherein the controlled temperature hot rolling reduction is about 30 to 40%.

26. The process of claim 22 wherein the age anneal is a double-aging treatment comprising a first anneal at about 720° C. to 780° C. for about 2 to 8 hours, followed by a second anneal between about 600° C. and 700° C. for about 4 to 16 hours.

* * * * *